US009630771B2

(12) United States Patent
D'Amato

(10) Patent No.: US 9,630,771 B2
(45) Date of Patent: Apr. 25, 2017

(54) CUP WITH AN INSERTED POT

(71) Applicant: Seda International Packaging Group SpA, Naples (IT)

(72) Inventor: Gianfranco D'Amato, Naples (IT)

(73) Assignee: Seda International Packaging Group SpA, Arzano, Naples ( * ) Notice: Subject to any disclaimer, the term of this patent is extended or adjusted under 35 U.S.C. 154(b) by 123 days.

(21) Appl. No.: 14/654,454

(22) PCT Filed: Dec. 17, 2013

(86) PCT No.: PCT/EP2013/003814

§ 371 (c)(1),
(2) Date: Jun. 19, 2015

(87) PCT Pub. No.: WO2014/095041

PCT Pub. Date: Jun. 26, 2014

(65) Prior Publication Data

US 2015/0329283 A1 Nov. 19, 2015

(30) Foreign Application Priority Data

Dec. 21, 2012 (DE) ..... 20 2012 012 309 U

(51) Int. Cl.
*B65D 85/816* (2006.01)

(52) U.S. Cl.
CPC ..... *B65D 85/816* (2013.01)

(58) Field of Classification Search
CPC ..... B65D 85/816
USPC ..... 426/86
See application file for complete search history.

(56) References Cited

U.S. PATENT DOCUMENTS 1,483,015 A * 2/1924 Schnackenberg .... B65D 85/816 229/125.17
1,933,468 A * 10/1933 Abbot ..... B65D 85/816 206/217
2,328,872 A * 9/1943 Yealdhall ..... B65D 85/816 206/217
2,667,423 A * 1/1954 Simpson ..... A23G 9/045 206/217
3,186,850 A 6/1965 Anthony
(Continued)

FOREIGN PATENT DOCUMENTS

DE 2810175 A1 9/1979
EP 2548817 A1 1/2013
(Continued)

OTHER PUBLICATIONS

International Search Report which issued May 26, 2014 in published PCT application No. WO 2014/095041 A1.

*Primary Examiner* — Erik Kashnikow
*Assistant Examiner* — Chaim Smith
(74) *Attorney, Agent, or Firm* — Fish & Richardson P.C.

(57) ABSTRACT

The cup (1) contains a pot (11), which preferably is filled with a concentrate of nutrition (19). The pot is closed by a lid (18) and is arranged close to the bottom of the cup and held against a vertical force, which may be applied, when the lid of the pot is torn off to use the contents of the pot. The pot shows a recess (16) at its outer structure, which is correlated to a shoulder (7) of the wall of the cup. When the pot is vertically inserted the recess snaps into the shoulder and provides a mechanical fixation.

15 Claims, 3 Drawing Sheets

(56) References Cited

U.S. PATENT DOCUMENTS

| | | | | |
|---|---|---|---|---|
| 3,526,316 | A * | 9/1970 | Kalogris | B65D 85/816 206/217 |
| 3,606,068 | A * | 9/1971 | Palmer | B65D 85/816 206/217 |
| 3,870,220 | A | 3/1975 | Koury et al. | |
| 4,836,370 | A | 6/1989 | Bosshard | |
| 6,692,780 | B1 * | 2/2004 | Sandin | A47G 19/16 426/112 |
| 2005/0220939 | A1 | 10/2005 | Morrow | |
| 2009/0297673 | A1 | 12/2009 | Sebban et al. | |

FOREIGN PATENT DOCUMENTS

| | | | |
|---|---|---|---|
| FR | 1367586 | A | 6/1964 |
| FR | 2097474 | A5 | 3/1972 |
| GB | 2355645 | A | 5/2001 |
| WO | 0030954 | A1 | 6/2000 |

* cited by examiner

CUP WITH AN INSERTED POT

CROSS REFERENCE TO PRIOR APPLICATIONS

This is a U.S. National Phase application under 35 U.S.C. §371 of International Patent Application No. PCT/EP2013/003814, filed Dec. 17, 2013, and claims the priority of German Patent Application No. 202012012309.2, filed Dec. 21, 2012 both of which are incorporated by reference herein in their entirety. The International Application published in English on Jun. 26, 2014 as WO 2014/095041 A4 under PCT Article 21.

The invention relates to a cup within which a pot is inserted. The pot may contain ingredients, such as coffee powder. In order to keep the ingredients secluded, the pot is preferably closed by a lid at its upper rim. When the cup shall be used the pot is opened by tearing off the lid and water is filled in.

The pot is positioned above the bottom of the cup and fixed to the cup bottom without glue. The fixation occurs by a shoulder of the cup wall, which holds the pot within the cup especially when the lid is torn off and a vertical force is applied.

U.S. Pat. No. 3,870,220 shows such a solution. The pot is inserted into the cup from above and is held by a shoulder of the cup wall, which is formed by a reduction of thickness of the wall in the range of the pot. The pot and the lid are neatly kept under the shoulder of the cup wall. The shoulder is formed by the upper part of the cup wall showing a thicker wall than the lower part.

It is an object of the invention to provide a cup according to the introductory part of the main claim, which provide a simple, glueless fixation of the pot within the cup.

The object is solved by the characterizing part of the main claim. The recess on the outer structure of the pot can be easily integrated into the structure and allows a fixation of the pot within the cup when the pot is practically vertically inserted therein. The recess provides a snap-on fit on the shoulder, irrespective of the shape and height of the pot. While in the prior art the shape and the volume of the pot are determined by the upper rim of the pot, the pot of the invention can be varied in its shape and height in view of the desired volume. If the pot contains coffee powder it may be less high than if it contains other nutrition, for example a dry noodle dish.

For the preparation of the dish the lid may be removed and the cup filled with hot water, whereby a proposed drink or dish is prepared.

The invention provides also the advantage, that the lid can be freely turned off, because the upper rim of the pot is free of any obstacle and the deletion of the lid is not restricted.

In a preferred further embodiment of the invention the pot contains at least one vertical rib, formed on the outer structure of the pot providing the recess. The rib may be integrated into the pot wall. The recess may have the shape of a U, which is horizontally opened to the outside.

In order to reach a symmetrical fixation of the pot within the cup it may be advisable, to have two or more ribs, which may be equally arranged over the circumference of the pot.

In order to allow an easy insertion of the pot within the cup and fixation thereof it may be advantageous, that the ribs are conically converging toward the bottom wall of the pot.

The insertion of the pot within the cup is further enhanced, if the diameter between the ribs at their lower end is smaller than the diameter between opposite shoulders.

In order to further simplify the pot it may have a conical wall in which the ribs are integrated.

In the following embodiments of the invention are described:

Figure 1:
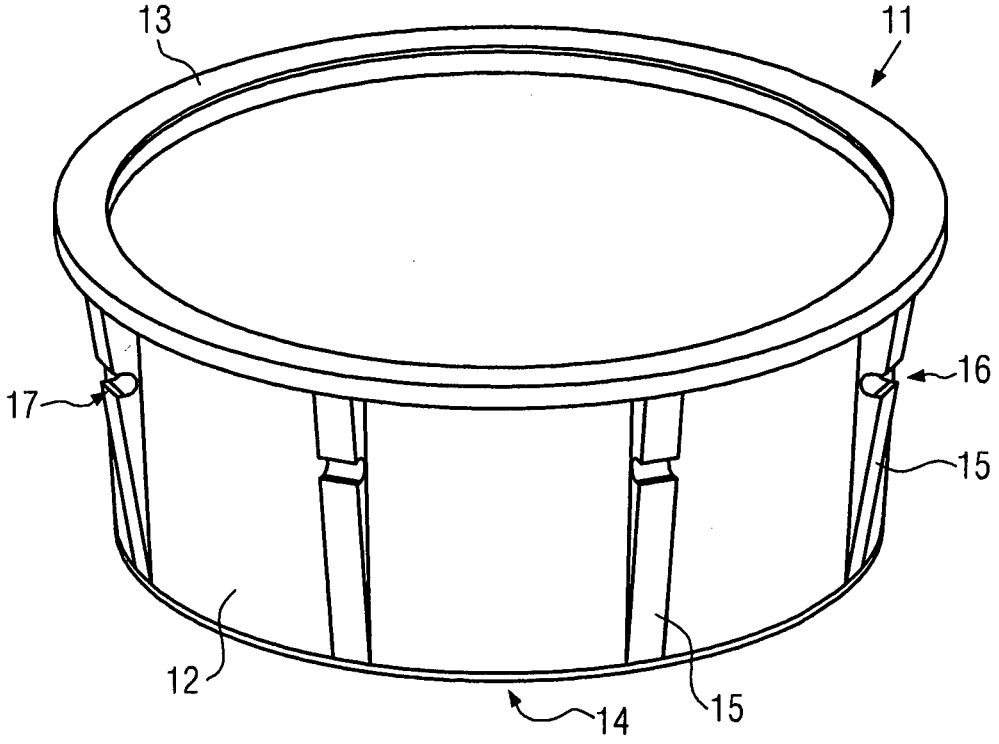
FIG. 1 shows a perspective view to a first embodiment of the pot.

The cup 1 of the first embodiment contains a cup wall 2 which is surrounded by an outer shell 3 being arranged in a small distance to the cup wall 2 thus providing an insulation space 4. The cup wall 2 and the shell 3 are conical, converging towards the lower end of the cup. The cup wall 2 is ending at the lower end of the cup together with a parallel flange 5 of a bottom 6.

Above the bottom 6 the cup wall 2 is provided with a shoulder 7 protruding inside and being positioned in a certain distance h, above the bottom 6. The shoulder 7 may be fully or partially formed over the circumference of the wall 2.

At the lower end the shell 3 is bent inwards by forming a roll 8. The roll may be positioned in the level of the bottom 6.

At the upper end the cup wall 2 is provided with a flat or rolled rim 9 which is surrounding the drinking opening 10 of the cup.

The pot may contain ingredients 19 and possess a wall 12, which—in the present case—may be kept vertical. At the upper end of the wall a flat rim 13 is arranged which is positioned in a vertical distance H above a bottom wall 14 of the pot. The distance H is larger than the distance h.

On the outside of the wall 12 ribs 15 are arranged extending from underneath the rim 13 downwards to the bottom wall 14 of the pot. Since the flat rim 13 has a larger diameter than the bottom wall 14 the ribs 15 are slightly inclined towards the lower end of the pot. In the present case the ribs are equally arranged on the circumference of the pot with an identical distance to each other. It is possible to have the ribs placed asymmetrically over the circumference.

Figure 2:
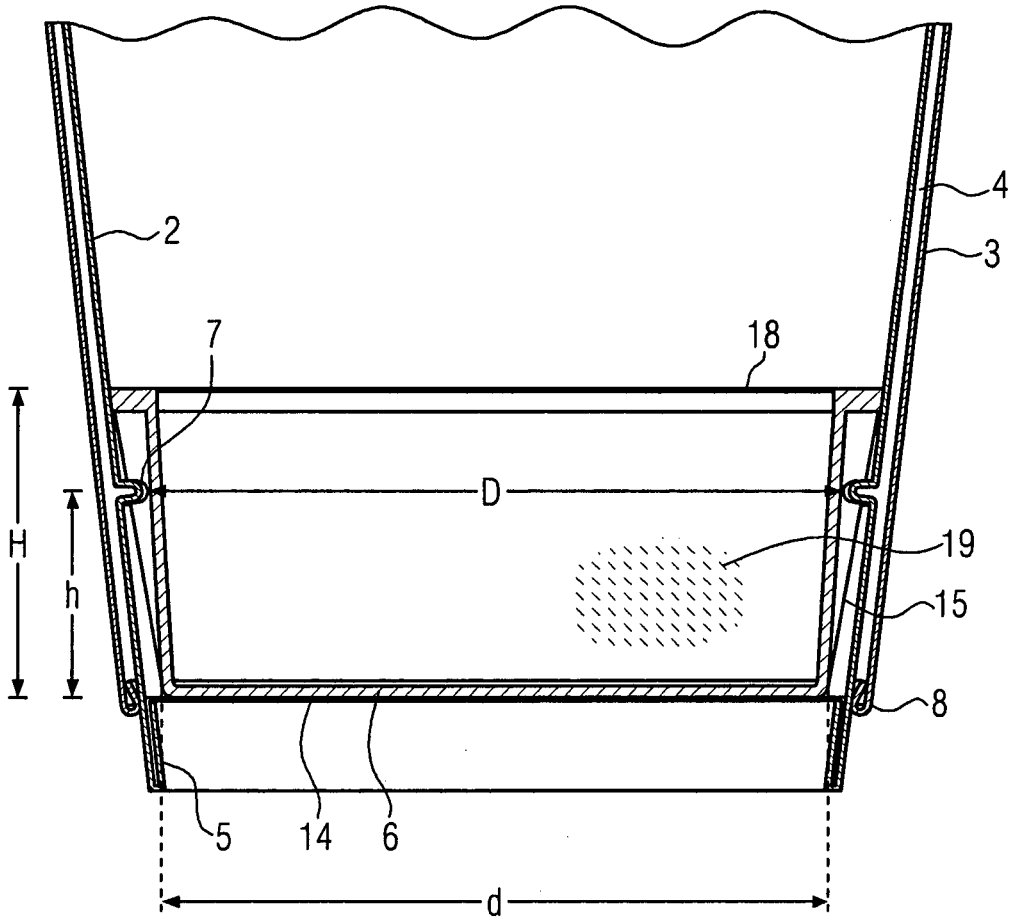
FIG. 2 shows a vertical cross section of the first embodiment with a pot inserted into a cup, whereby the left rib is fully cut and the right rib is shown as a front view.

Each rib 15 shows a recess 16 being placed upwards from the bottom wall, in order to correlate with the shoulder 7 of the cup when inserted. The distance between recesses 16 and a bottom wall 14 of the pot more or less correlates with a distance h as shown in FIG. 2.

The recesses 16 have openings 17 with approximate U-shaped cross section. They are preferably horizontal orientated. When the pot 11 is inserted into the cup 1 it may slide down into the interior of the cup in order to be positioned next to the bottom 6.

Figure 3:
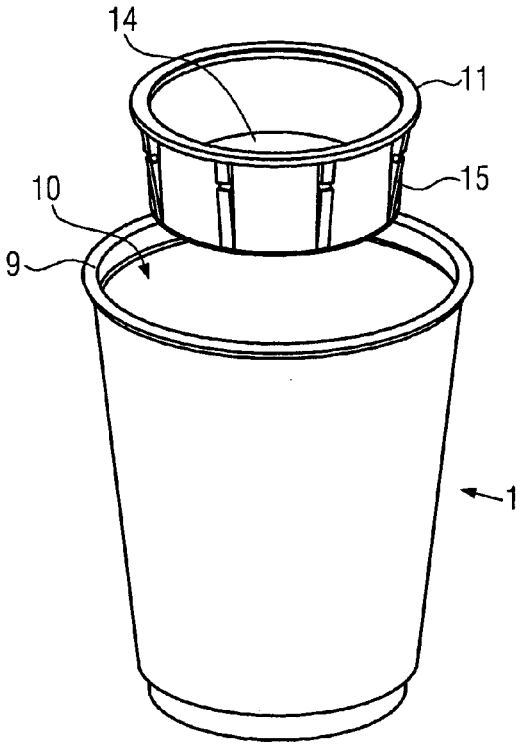
FIG. 3 shows the pot above the cup of FIGS. 1 and 2 before insertion and FIG. 4 shows a vertical cut through a second embodiment.

The diameter d at the lower end of the wall 12 of the pot is smaller than a diameter D between opposite shoulders 7. As a consequence of this relationship the pot 11 can be totally inserted downwards within the cup 1 whereby the conical ribs 15 provide some guidance in the downward movement until the recesses 16 of the ribs 15 snap in the shoulder 7 of the cup wall 2 thereby mechanically fixing the pot within the cup. In FIG. 3 a perspective view is given on a cup 1 which—in the present case—shows a double-wall structure, as may easily be seen from FIG. 2. A lid 18 may be placed on top of the rim 13 to close the pot 11. It may be stripped off with the help of a flap 20.

Figure 4:
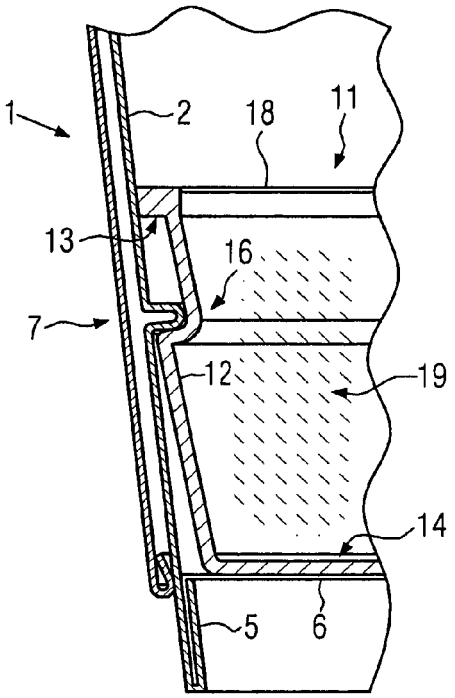

FIG. 4 shows a vertical cut through a second embodiment.

Identical items are designated with identical reference numbers. In order to avoid any repetition, in the following it is only made reference to new or amended features.

The second embodiment shows a cup which is only made out of a single wall 2. The shoulder 7 is again a part of the cup wall 2 and protruding inside by forming a crease which may be extending over the full circumference of the cup wall or only a part thereof.

One difference between the second embodiment and the first one is the creation of the wall 12 of the pot 11. In the second embodiment the wall 12 of the pot 11 is kept conical, whereby it is converging to the lower end of the pot. The recess 16 is integrated into the cup wall by reducing the diameter of the wall 12 above the level of shoulders 7 and/or vertically enlarging the recess 16 up to the flat rim 13 of the pot.

The pot may be made out of paper or carton, thus, providing a fully recyclable cup.

The pot 11 may be sealed on top of the flat rim 13 with a lid 18 preserving the contents 19 from the outside. The lid 18 may be torn off for the preparation of the use of contents 19. If the contents are made out of coffee powder, hot water is added and filled up to the proposed level of the cup in order to provide the required beverage.

Again a clueless, mechanical fixation of the pot 11 within the cup 1 is given. The inclined wall 12 of the pot allows an easy vertical insertion of the pot into the cup for safely placing the same therein. The conically shaped wall 12 allows a guidance when the pot is inserted. The recess 16 guarantees a snap-in fit when the pot is placed.

The invention is not restricted to the embodiment shown.

The distance h is depending to the height and/or volume of the ingredients to be contained in the pot. The invention allows, that with one standard cup a variety of pots with different volume and shapes may be placed.

The cup may be consisting from paper, carton or there like, whereas the pot may be made from plastic, but also paper, carton etc. is a possibility.

The invention claimed is:

1. A cup comprising a pot inserted therein, the pot containing beverage ingredients and closed by a lid, the pot positioned above the bottom of the cup and fixed to a shoulder of the cup, the pot having a recess on the outer structure of the pot, the recess cooperating with the shoulder in a snap on fit when vertically inserted, and wherein the pot contains at least one vertical rib formed on the outer structure of the pot into which rib the recess is formed.

2. The cup according to claim 1, wherein two or more ribs are equally arranged over the circumference of the pot.

3. The cup according to claim 2, wherein the ribs are conically converging towards the bottom wall of the pot.

4. The cup according to claim 2, wherein the ribs are conically converging towards the bottom wall of the pot.

5. The cup according to claim 2, wherein the rib ends underneath the flat rim.

6. The cup according to claim 2, wherein the recess has an opening with a U-shaped cross section and is horizontally orientated.

7. The cup according to claim 1, wherein the ribs are conically converging towards the bottom wall of the pot.

8. The cup according to claim 7, wherein the diameter of the circumference of the ribs at their lower end is smaller than the diameter between opposite shoulders of the cup wall.

9. The cup according to claim 8, characterized in that wherein the pot has a conical wall, in which the ribs and/or the recess are integrated.

10. The cup according to claim 9, wherein the recess has an opening with an U-shaped cross section and being horizontally orientated.

11. The cup according to claim 10, wherein the rib is extending between the bottom wall and the flat rim of the pot.

12. The cup according to claim 11, wherein the rib is ending underneath the flat rim.

13. The cup according to claim 12 wherein the rib is ending underneath the flat rim.

14. The cup according to claim 1, wherein the diameter of the circumference of the ribs at their lower end is smaller than the diameter ED) between opposite shoulders of the cup wall.

15. The cup according to claim 1, wherein the rib extends between the bottom wall and the flat rim of the pot.

* * * * *